US009334023B2

(12) United States Patent
Admire

(10) Patent No.: US 9,334,023 B2
(45) **Date of Patent: *May 10, 2016**

(54) AUXILIARY DECK FOR PONTOON BOAT

(71) Applicant: Woodrow Wilson Admire, Independence, MO (US)

(72) Inventor: Woodrow Wilson Admire, Independence, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/726,095

(22) Filed: May 29, 2015

(65) Prior Publication Data

US 2015/0259036 A1 Sep. 17, 2015

Related U.S. Application Data

(63) Continuation of application No. 14/045,591, filed on Oct. 3, 2013, now Pat. No. 9,067,646.

(51) Int. Cl.

| | |
|---|---|
| ***B63B 17/04*** | (2006.01) |
| ***B63B 17/00*** | (2006.01) |
| ***B63B 7/04*** | (2006.01) |
| ***B63B 29/00*** | (2006.01) |
| ***B63B 35/34*** | (2006.01) |
| ***B63B 35/613*** | (2006.01) |
| ***B63B 35/73*** | (2006.01) |
| *B63B 3/48* | (2006.01) |
| *B63B 7/00* | (2006.01) |

(52) U.S. Cl.

CPC . *B63B 7/04* (2013.01); *B63B 29/00* (2013.01); *B63B 35/34* (2013.01); *B63B 35/613* (2013.01); *B63B 35/73* (2013.01); *B63B 2003/485* (2013.01); *B63B 2007/003* (2013.01)

(58) Field of Classification Search

CPC ..... B63B 17/00; B63B 17/04
USPC ..... 114/364
See application file for complete search history.

(56) References Cited

U.S. PATENT DOCUMENTS

| | | | | |
|---|---|---|---|---|
| 5,297,978 | A * | 3/1994 | Ramsey | B63B 7/08 114/345 |
| 5,915,328 | A * | 6/1999 | Rowan | B63B 27/14 114/362 |
| 6,189,477 | B1 * | 2/2001 | Cody | B63B 38/00 114/123 |
| 7,004,101 | B1 * | 2/2006 | Mardikian | B63B 19/08 114/362 |
| 7,134,400 | B2 * | 11/2006 | Blank | B63B 27/143 114/362 |
| 7,228,811 | B2 * | 6/2007 | Huff | B63B 19/14 114/201 R |
| 8,028,641 | B1 * | 10/2011 | Sly | B63B 27/146 114/362 |
| 8,146,526 | B2 * | 4/2012 | Gros | B63B 19/08 114/201 R |
| 8,365,472 | B2 * | 2/2013 | Grimaldi | B63B 17/04 114/362 |
| 2007/0022938 | A1 * | 2/2007 | Fishburn | B63B 17/04 114/364 |
| 2013/0174771 | A1 * | 7/2013 | Teague | B63B 25/00 114/343 |

* cited by examiner

*Primary Examiner* — Lars A Olson
*Assistant Examiner* — Jovon Hayes
(74) *Attorney, Agent, or Firm* — Hovey Williams, LLP

(57) ABSTRACT

An auxiliary deck assembly for a pontoon boat includes a stowable auxiliary deck and mounting structure. The mounting structure swingably supports the auxiliary deck for swinging movement between stowed and operating positions. The auxiliary deck is configured so that the auxiliary deck surface is generally aligned with the primary deck surface when the auxiliary deck is in the operating position. The auxiliary deck is further configured so that the auxiliary deck surface is oriented at a generally upright angle relative to the primary deck surface when the auxiliary deck is in the stowed position.

12 Claims, 7 Drawing Sheets

AUXILIARY DECK FOR PONTOON BOAT

RELATED APPLICATION

This is a continuation of prior application Ser. No. 14/045,591, filed Oct. 3, 2013, entitled AUXILIARY DECK FOR PONTOON BOAT, which is hereby incorporated in its entirety by reference herein.

BACKGROUND

1. Field

The present invention relates generally to watercraft. More specifically, embodiments of the present invention concern a stowable auxiliary deck mounted on a pontoon boat to support one or more occupants.

2. Discussion of Prior Art

Pontoon boats are well known and commonly used for various leisure boating activities on rivers, ponds, lakes, and other bodies of water. Conventional boating activities where pontoons are used include cruising, swimming, and towing a person while the person is tubing or skiing. Pontoon boats typically include a deck supported on at least two cylindrical pontoon floats. Such boats also typically include a railing mounted on the deck, where the railing encircles an area for one or more occupants to ride on the pontoon.

However, conventional pontoons and other conventional watercraft used for leisure activities have certain deficiencies. For instance, the structure of prior art pontoons unduly restricts occupants from conveniently accessing the water adjacent to the pontoon. Prior art pontoons also provide a very limited amount of unrestricted deck space along the outboard margin of the pontoon deck. This limited space condition along the outboard deck margins is particularly inconvenient for certain leisure activities, such as fishing.

SUMMARY

The following brief summary is provided to indicate the nature of the subject matter disclosed herein. While certain aspects of the present invention are described below, the summary is not intended to limit the scope of the present invention.

Embodiments of the present invention provide a pontoon boat that does not suffer from the problems and limitations of the prior art pontoons set forth above.

A first aspect of the present invention concerns an auxiliary deck assembly for a pontoon boat. The pontoon boat includes a primary deck having a primary deck surface that extends between the port and starboard sides, at least one pontoon, and a frame mounting the primary deck to the at least one pontoon. The auxiliary deck assembly broadly includes a stowable auxiliary deck, mounting structure, and a stop. The stowable auxiliary deck presents an auxiliary deck surface. The mounting structure is configured to mount the auxiliary deck on the frame. The mounting structure swingably supports the auxiliary deck for swinging movement between stowed and operating positions. The auxiliary deck is configured so that the auxiliary deck surface extends laterally relative to the to the primary deck surface when the auxiliary deck is in the operating position, such that the auxiliary deck surface defines an outboard extension of the primary deck surface. The auxiliary deck is further configured so that the auxiliary deck surface is oriented at a generally upright angle relative to the primary deck surface when the auxiliary deck is in the stowed position. The stop is operable to prevent swinging of the auxiliary deck beyond the operating position when the auxiliary deck is swung in the direction from the stowed position to the operating position, with the stop thereby providing support to the auxiliary deck in the operating position.

A second aspect of the present invention concerns an auxiliary boat deck assembly operable to be shiftably attached relative to a boat deck, with the auxiliary boat deck assembly providing an extension of the exposed supporting surface of the boat deck. The auxiliary boat deck assembly broadly includes a stowable auxiliary deck, mounting structure, and an auxiliary deck rail. The mounting structure is configured to support the auxiliary deck relative to the boat deck for movement between stowed and operating positions. The auxiliary deck is configured so as to extend laterally relative to the boat deck when the auxiliary deck is in the operating position, with the auxiliary deck thereby defining the extension of the exposed supporting surface of the boat deck. The auxiliary deck rail is pivotally mounted on the auxiliary deck for swinging movement between retracted and extended positions. The auxiliary deck rail projects generally transversely from the auxiliary deck when in the extended position. The auxiliary deck rail is positioned generally alongside the auxiliary deck when in the retracted position.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein.

Figure 4:
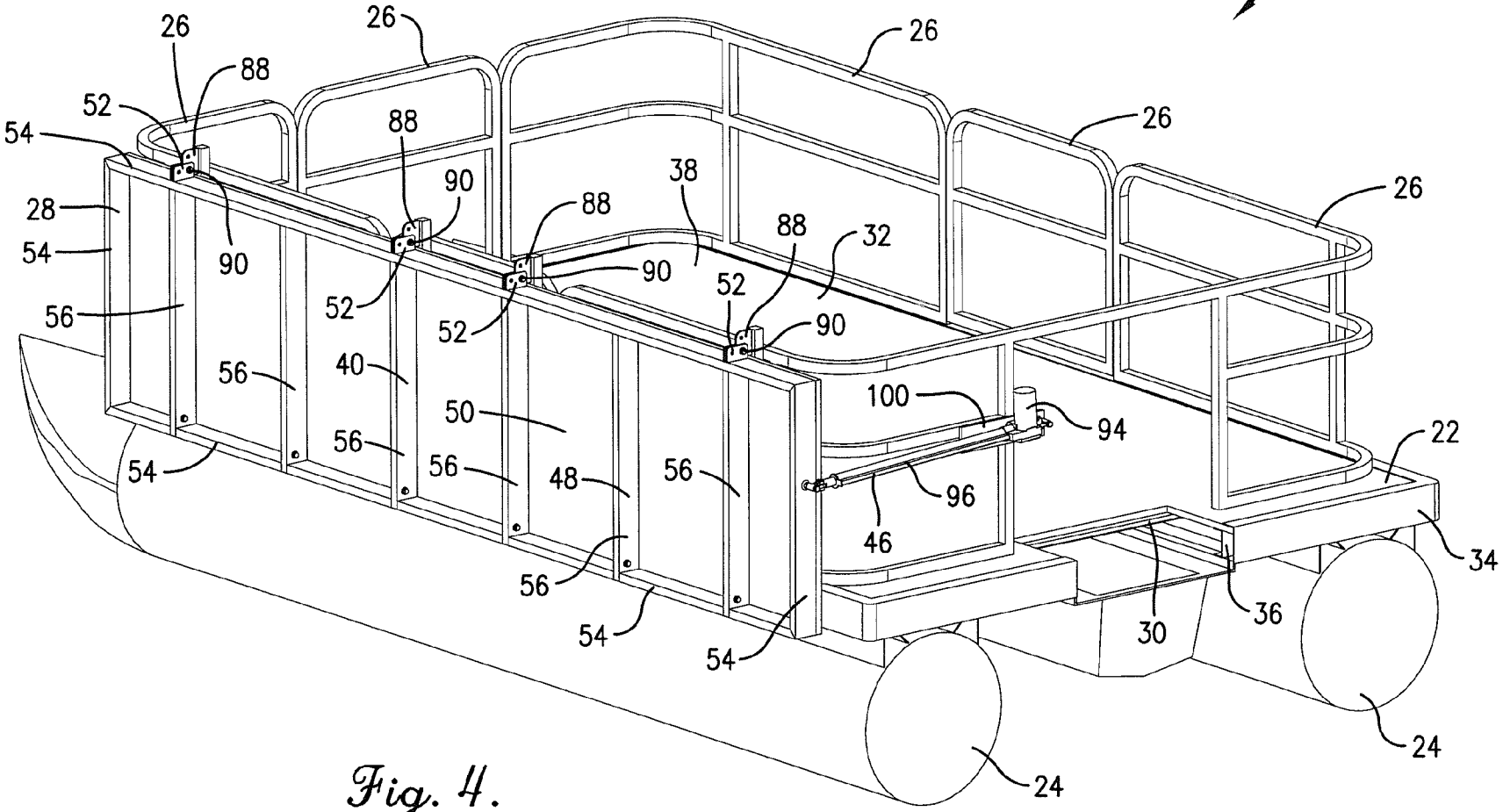
FIG. 4 is a rear perspective of the pontoon similar to FIG. 3, but showing a piston of the linear actuator retracted from an outer position to an inner position so that the auxiliary deck assembly is swung into a stowed position.
Figure 5:
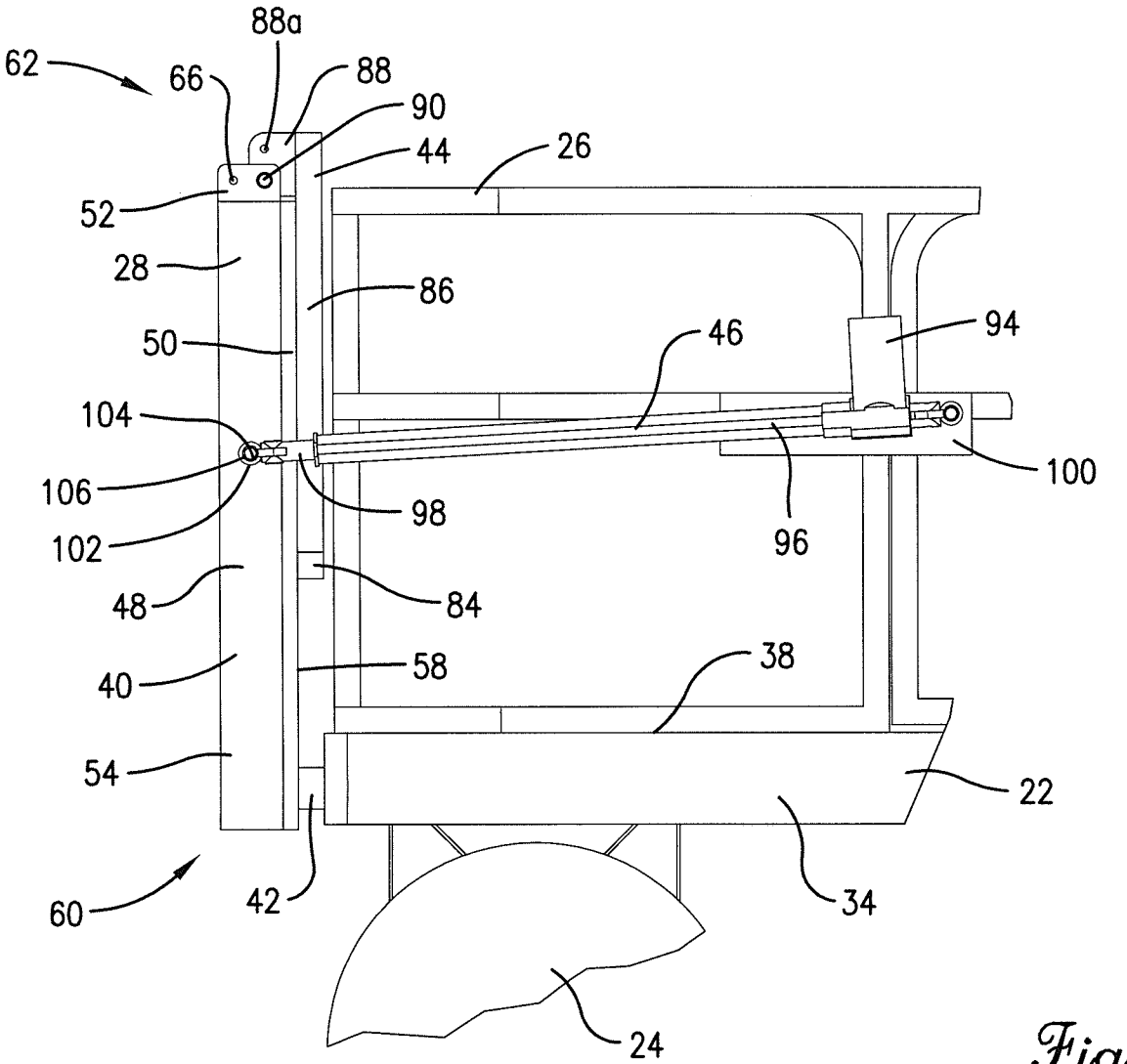
FIG. 5 is a fragmentary rear elevation of the pontoon similar to FIG. 2, but showing the piston of the linear actuator in the inner position and the auxiliary deck assembly swung into the stowed position.
Figure 6:
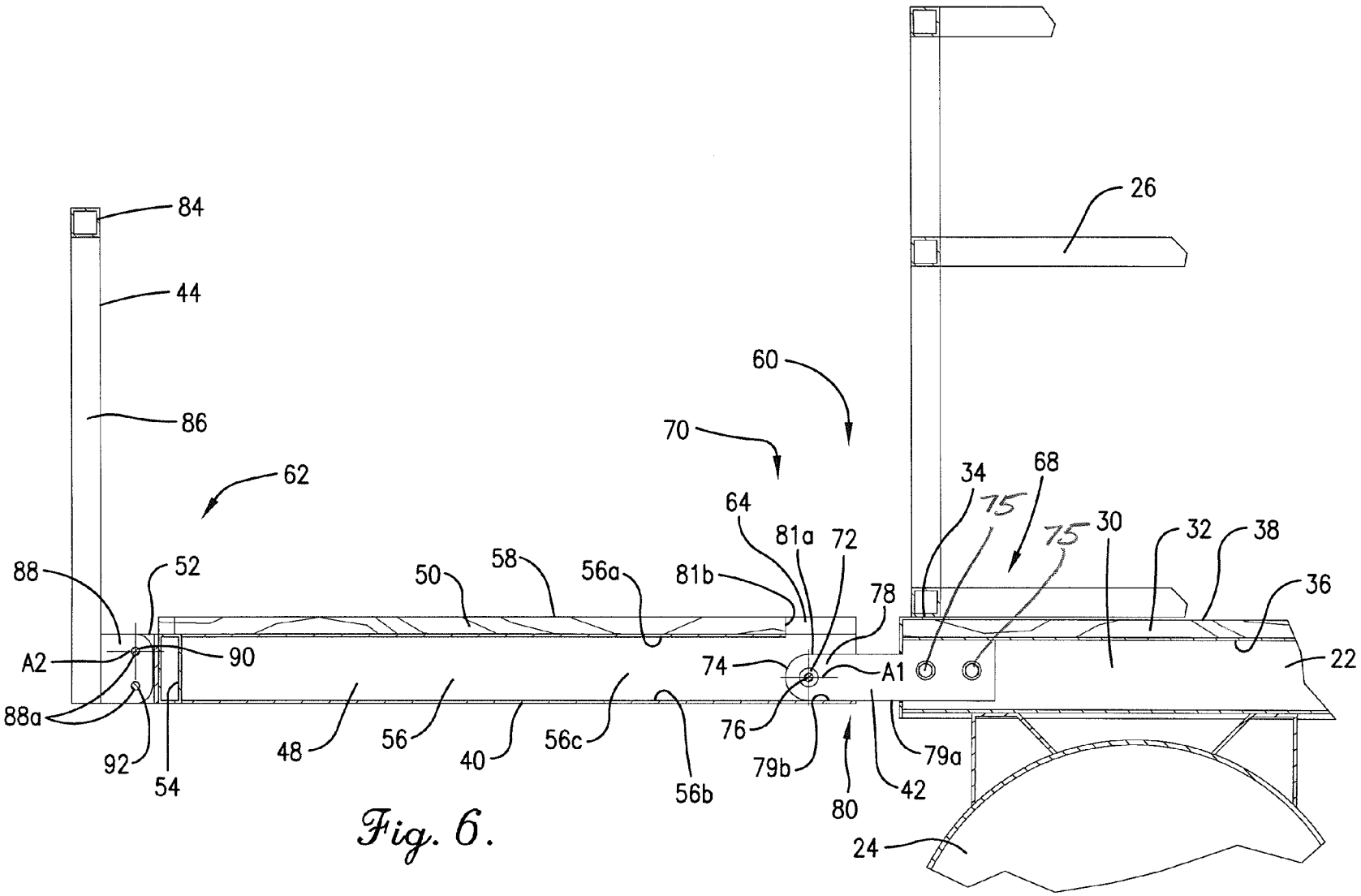
Figure 8:
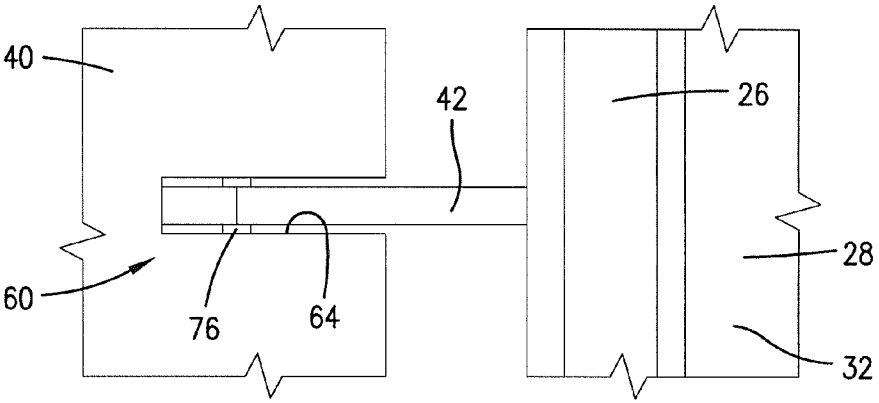
Figure 7:
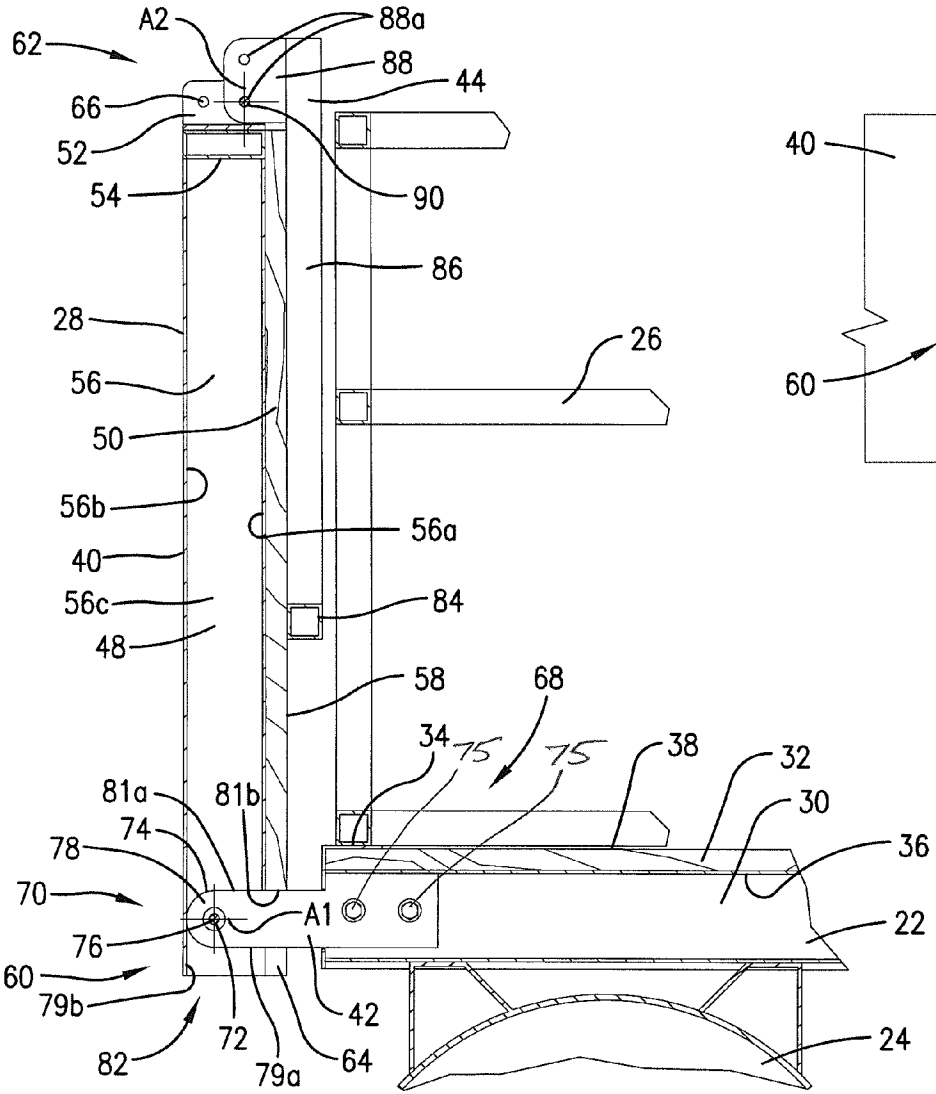

FIG. 6 is an enlarged fragmentary cross section of the pontoon shown in FIGS. 1-5, showing the auxiliary deck assembly in the operating position and the rod rails in the extended position, with the rod rails being locked in the extended position by removable pins, and showing one of the platform mounting brackets extending from the primary deck assembly into one of the slots presented by the platform;

FIG. 7 is an enlarged fragmentary cross section of the pontoon similar to FIG. 6, but showing the auxiliary deck assembly in the stowed position; and FIG. 8 is a fragmentary top view of the pontoon shown in FIGS. 1-7, showing one of the platform mounting brackets extending from the primary deck assembly into one of the slots presented by the platform.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 1:
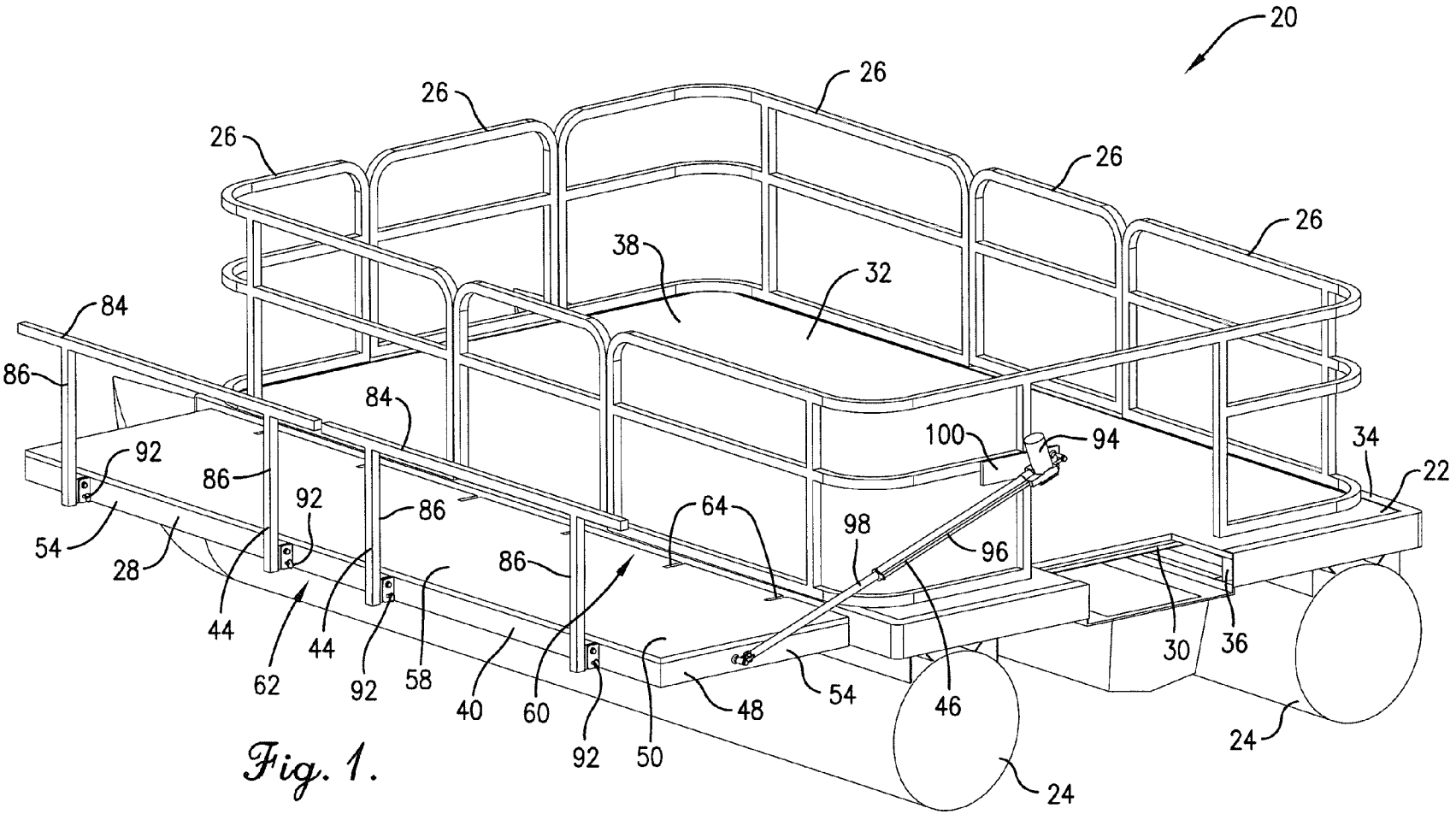
FIG. 1 is a rear perspective of a pontoon constructed in accordance with a preferred embodiment of the present invention, with the pontoon including a primary deck assembly, pontoon floats, railing, and an auxiliary deck assembly.

Turning initially to FIG. 1, a pontoon 20 is constructed in accordance with a preferred embodiment of the present invention. As is customary with this type of vessel, the pontoon 20 is designed for various leisure boating activities. The disclosed invention is preferably used when the pontoon 20 is floating on a body of water (not shown).

The illustrated pontoon 20 preferably includes a primary deck assembly 22, pontoon floats 24, railing 26, and an auxiliary deck assembly 28. While not depicted, the pontoon 20 also preferably includes, among other things, a motor, pontoon operating controls, and seating. Other than the auxiliary deck assembly 28, the pontoon 20 is preferably a conventional pontoon craft.

The primary deck assembly 22 preferably includes a frame 30, primary deck 32, and trim 34 (see FIGS. 6 and 7). The frame 30 preferably includes a plurality of aluminum, channel-shaped beams 36 that extend laterally from the port side of the pontoon 20 to the starboard side. The primary deck 32 is secured in a covering relationship to the frame 30 and is preferably formed by multiple pieces of three-quarter (¾) inch plywood. However, the primary deck 32 could include one or more alternative materials or be alternatively constructed without departing from the scope of the present invention.

The primary deck 32 presents an exposed primary deck surface 38 of the primary deck assembly 22. The trim 34 preferably includes an aluminum angle material that extends continuously about the deck 32. The railing 26 extends along the perimeter of the primary deck assembly 22 and is secured thereto with a series of fasteners (not shown) that extend through a lowermost bar of the railing 26 and into the primary deck 32. However, it will be appreciated that the primary deck assembly 22 could be alternatively configured without departing from the scope of the present invention.

The illustrated invention is preferably provided as part of the pontoon 20. However, the principles of the present invention are equally applicable where the inventive auxiliary deck assembly 28 is used in connection with an alternative water craft, such as a conventional deck boat, V-hull watercraft, etc.

Figure 2:
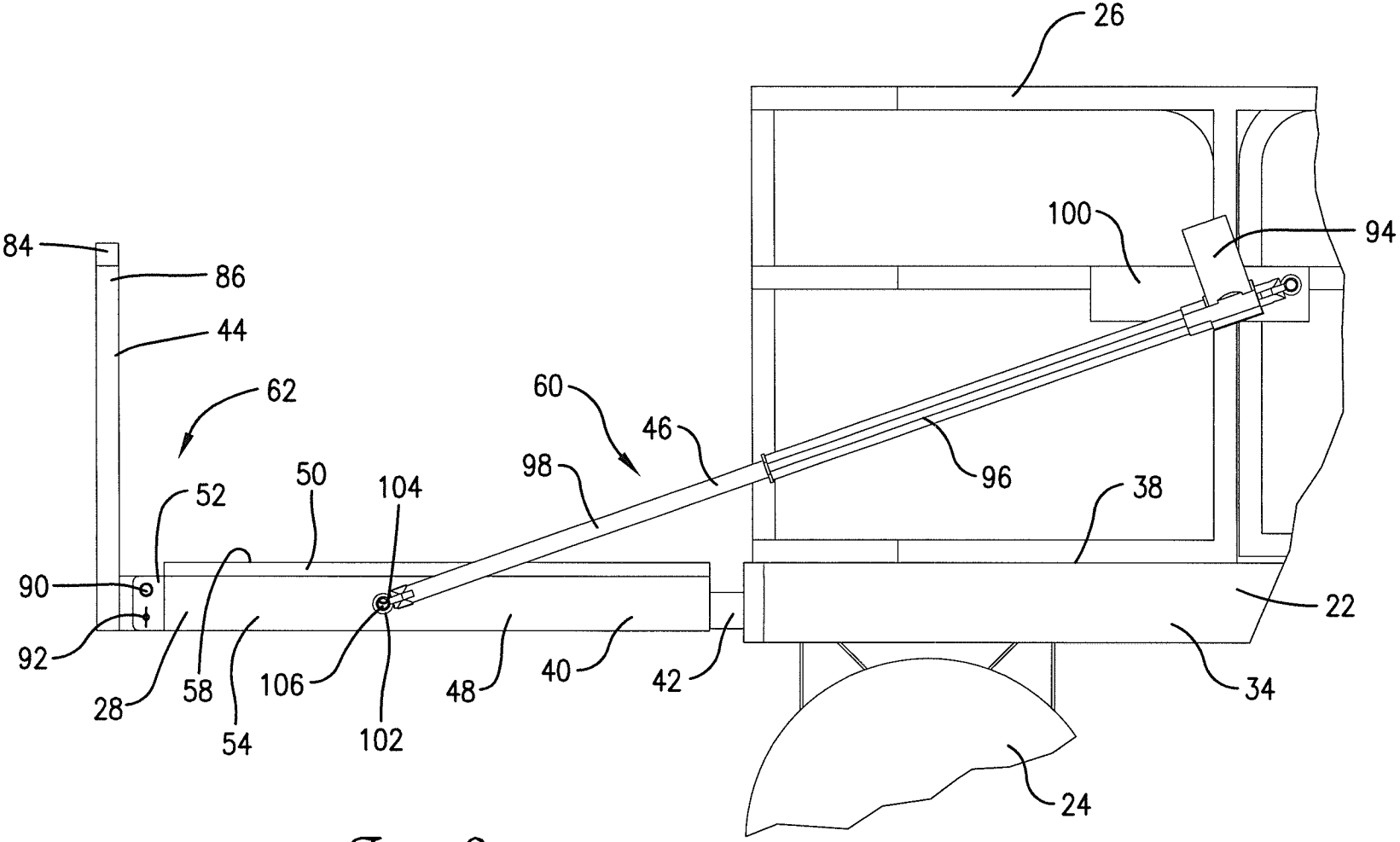
FIG. 2 is a fragmentary rear elevation of the pontoon shown in FIG. 1, with the auxiliary deck assembly including a platform, a pair of rod rails, platform mounting brackets, and a linear actuator, showing the auxiliary deck assembly in an operating position and the rod rails in an extended position.

Turning to FIGS. 1, 2, and 6, the auxiliary deck assembly 28 is designed for use with the pontoon 20 to provide a convenient outboard extension of the primary deck 32. The illustrated auxiliary deck assembly 28 is preferably used to provide a convenient and comfortable space for one or more occupants to fish from the pontoon 20. However, it is also within the ambit of the present invention where the auxiliary deck assembly 28 is used for other purposes associated with the pontoon 20. It will also be appreciated that the inventive auxiliary deck assembly 28 can be installed on the pontoon 20 either as original equipment or as an aftermarket kit.

The auxiliary deck assembly 28 preferably includes a platform 40, platform mounting brackets 42, rod rails 44, and a powered actuator 46. As will be discussed, the illustrated auxiliary deck assembly 28 is located on the port side of the pontoon 20. However, it is within the ambit of the present invention where the auxiliary deck assembly 28 is located on the starboard side, the bow, or the stern to provide a corresponding outboard extension of the primary deck. Yet further, the pontoon 20 could have multiple auxiliary deck assemblies 28 located at corresponding ones of these locations along the perimeter of the pontoon 20 to provide multiple outboard deck extensions.

The platform 40 preferably includes an aluminum platform frame 48, a platform deck 50 covering the platform frame 48, and platform tabs 52. The platform frame 48 includes perimeter beams 54 and a plurality of lateral beams 56. The illustrated beams 54,56 are preferably welded to one another to form a unitary, rigid frame structure. Each of the lateral beams 56 preferably includes aluminum rectangular tubing with one inch (1") wide top and bottom walls 56*a,b* and three inch (3") long side walls 56*c* (see FIGS. 6 and 7). The illustrated perimeter beams 54 have walls with the same dimensions as the lateral beams 56. However, it is within the ambit of the present invention where the beams 54,56 are alternatively sized and/or shaped. Furthermore, other aspects of the platform frame 48 could be alternatively configured. For instance, the platform frame 48 could be manufactured from alternative materials.

The platform deck 50 is preferably formed by multiple pieces of three-quarter inch (¾") plywood. The plywood pieces are secured to the frame with conventional fasteners so that the platform deck 50 substantially covers the top side of the platform frame 48. The installed platform deck 50 presents a top auxiliary deck surface 58 of the auxiliary deck assembly 28. However, the principles of the present invention are applicable where the platform deck 50 is alternatively constructed. For instance, the platform deck 50 could include one or more alternative materials or be alternatively constructed without departing from the scope of the present invention. While not depicted in the illustrated embodiment, it is within the ambit of the present invention where the bottom side of the platform frame 48 is also covered with a deck structure (e.g., to improve the aesthetic design of the platform 40).

The platform frame 48 and platform deck 50 cooperatively present inboard and outboard margins 60,62 of the platform 40 that define a width of the platform (see FIG. 6). The platform 40 also presents a platform length that is approximately the length of the pontoon 20 and greater than the platform width in the illustrated embodiment. However, the principles of the present invention are applicable where the platform 40 is alternatively sized to change the platform length and/or the platform width. The platform frame 48 and platform deck 50 also cooperatively present inboard slots 64 located along the inboard margin 60 and spaced along the length of the platform (see FIGS. 3, 6, 7 and 8). Each slot 64 is formed between the side walls 56*c* of the corresponding lateral beam 56, with the slot 64 projecting upwardly through the platform deck 50 along the inboard margin 60. As will be discussed, the inboard slots 64 are configured to receive the platform mounting brackets 42.

Each platform tab 52 preferably includes a plate presenting a pair of holes 66 (see FIG. 7). The platform tabs 52 are welded to the perimeter beam 54 along the outboard margin 62.

Each platform mounting bracket 42 preferably includes an elongated aluminum plate that presents inboard and outboard ends 68,70 (see FIGS. 6 and 7). The platform mounting bracket 42 also presents a hole 72 and a rounded outer edge 74 at the outboard end 70 and a pair of inboard holes (not shown) adjacent the inboard end 68.

The platform mounting brackets 42 are preferably fastened to the frame 30 at spaced locations along the port side, with the outboard ends 70 projecting outwardly from the frame 30 through slots in the trim 34. Each platform mounting bracket 42 is fastened to a corresponding one of the beams 36 with a pair of threaded bolts 75 that extend through holes in the corresponding beam 36 and through inboard holes in the platform mounting bracket 42. The bolts 75 are preferably secured by threaded nuts (not shown) on the opposite side of the bolt heads. However, it is within the ambit of the present invention where the platform mounting brackets are alternatively attached to the frame 30. It will also be appreciated that the platform mounting brackets 42 could be alternatively shaped and/or configured to support the auxiliary deck assembly 28 without departing from the scope of the present invention.

Turning to FIGS. 2-7, the illustrated auxiliary deck assembly 28 is preferably pivotally mounted on the pontoon 20. Each platform mounting bracket 42 is slidably received in a corresponding slot 64 presented by the auxiliary deck assembly 28. The auxiliary deck assembly 28 is attached to the platform mounting brackets 42 with pins 76 to form hinge joints 78 that permit swinging movement about a deck hinge axis A1 (see FIGS. 6 and 7).

Figure 3:
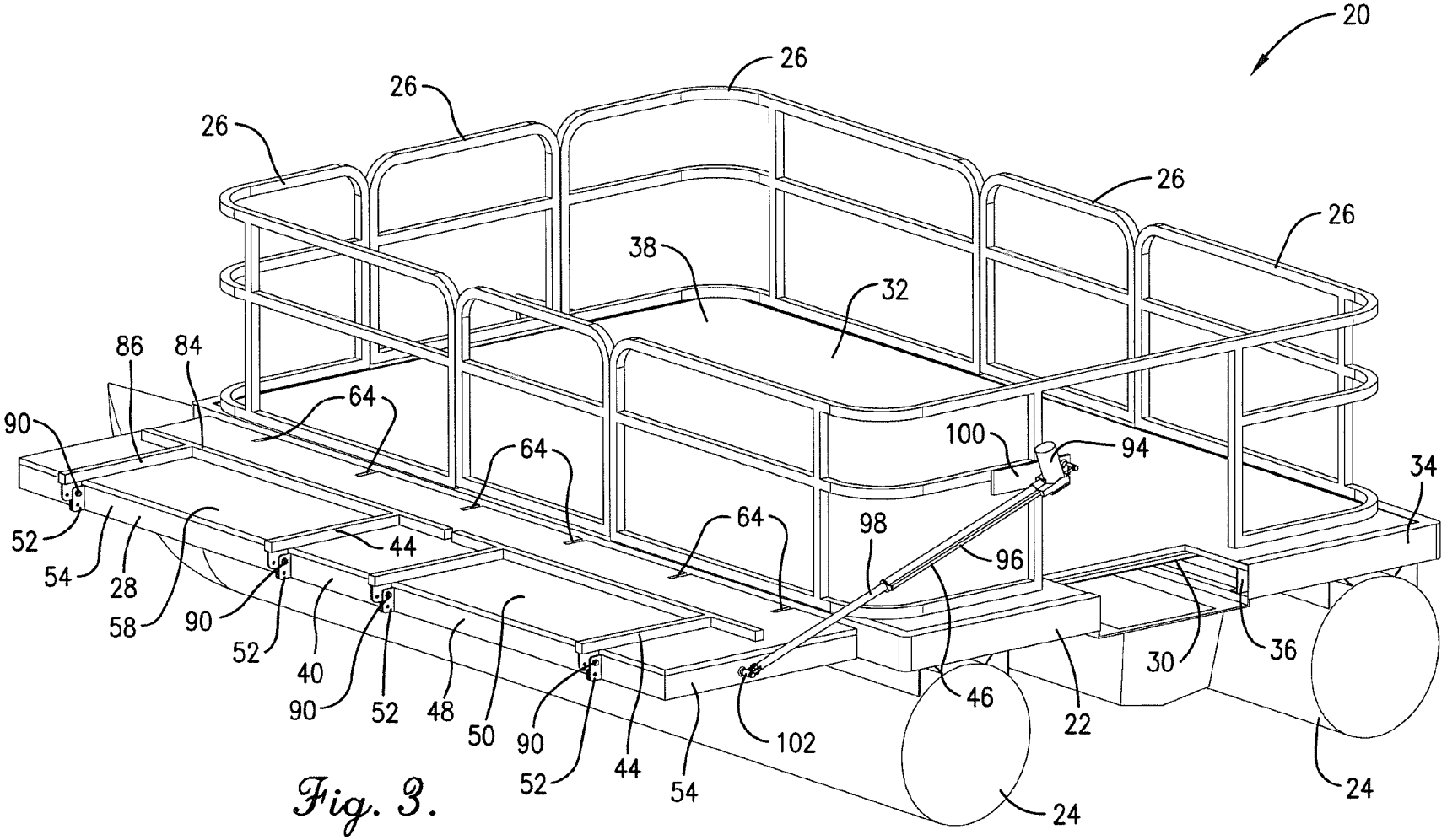
FIG. 3 is a rear perspective of the pontoon similar to FIG. 1, but showing the rod rails in a retracted position.

The auxiliary deck assembly 28 preferably pivots relative to the primary deck assembly 22 between a laterally-extending operating position (see FIGS. 2, 3, and 6) and an upright stowed position (see FIGS. 4, 5, and 7). As will be explained below, the powered actuator 46 is preferably used to power the auxiliary deck assembly 28 between the positions.

When deployed in the operating position, the auxiliary deck assembly 28 preferably operates to expand the usable deck area of the pontoon 20. Also, the auxiliary deck surface 58 of the auxiliary deck assembly 28 is preferably substantially parallel to the deck surface 38 of the primary deck assembly 22 in the operating position. More preferably, the auxiliary deck surface 58 and primary deck surface 28 are substantially aligned or coplanar. However, the auxiliary deck surface 28 could be alternatively located when the auxiliary deck assembly 28 is deployed in the operating position without departing from the scope of the present invention (e.g., where the deck surfaces 38,58 are substantially parallel but spaced from one another along a direction normal to the surfaces).

In the operating position, each platform mounting bracket 42 presents a face 79*a* that preferably interengages another face 79*b* presented by the bottom wall 56*b* of the corresponding lateral beam 56 to restrict downward swinging movement of the auxiliary deck assembly 28 relative to the primary deck assembly 22 (see FIG. 6). In other words, the faces 79*a,b* complementally engage one another in the operating position and cooperatively provide a preferred stop 80 to restrict downward swinging of the deployed auxiliary deck assembly 28 when the auxiliary deck assembly 28 is swung in the direction from the stowed position to the operating position. Thus, the stops 80 cooperatively support at least some of the weight of the auxiliary deck assembly 28. The stops 80 are also operable to support the weight of anything or anyone supported by the auxiliary deck assembly 28. However, it is also within the ambit of the present invention where an alternative stop mechanism is provided to restrict downward swinging of the auxiliary deck assembly 28 beyond the operating position. Yet further, an alternative stop mechanism could be employed to support the weight one or more objects, people, etc. supported by the auxiliary deck assembly 28.

In the stowed position, the illustrated auxiliary deck assembly 28 extends in an upright orientation alongside the railing 26. Furthermore, the auxiliary deck surface 58 is preferably oriented at a generally upright angle relative to the primary deck surface 38 in the stowed position. Furthermore, the auxiliary deck assembly 28 and the railing 26 are preferably in close proximity to one another when the auxiliary deck assembly 28 is stowed.

Also in the stowed position, each platform mounting bracket 42 presents a face 81*a* that preferably interengages another face 81*b* presented by the top wall 56*a* and platform deck 50 to restrict inboard swinging movement of the auxiliary deck assembly 28 relative to the primary deck assembly 22 (see FIG. 7). In other words, the faces complementally engage one another in the stowed position and cooperatively provide a preferred stop 82 to restrict swinging of the auxiliary deck assembly 28 when the auxiliary deck assembly 28 is swung in the direction from the operating position to the stowed position. However, the principles of the present invention are applicable where an alternative stop mechanism is provided to restrict inboard swinging of the stowed platform 40.

As will be discussed, the powered actuator 46 also restricts swinging of the platform 40 when the powered actuator 46 is not driving the platform 40. Furthermore, the pontoon 20 could have alternative structure to restrict swinging movement of the platform 40 when the platform 40 is located in a position other than the operating and stowed positions.

While the illustrated stowed arrangement of the auxiliary deck assembly 28 is preferred, the auxiliary deck assembly 28 could be alternatively located when in the stowed position. For instance, the auxiliary deck assembly 28 could be located either partly or entirely within a pocket presented by the pontoon 20 when stowed. In one such alternative embodiment, the primary deck assembly 22 could present a laterally extending pocket that shiftably receives at least part of the auxiliary deck assembly 28 in the stowed position.

Preferably, the auxiliary deck assembly 28 only minimally extends outboard of the port side of the primary deck assembly 22 when the auxiliary deck assembly 28 is in the stowed position. This arrangement enables the pontoon 20 to be stowed and/or otherwise used in locations sized for conventional pontoons, such as a conventional boat slip or a conventional pontoon trailer. It is also within the ambit of the present where the auxiliary deck assembly 28 is shiftably mounted so that the auxiliary deck assembly 28 does not extend outboard of the port side of the primary deck assembly 22 (or outboard of any other outboard margin of the primary deck assembly 22) in the stowed position.

While the auxiliary deck assembly 28 preferably pivots between operating and stowed positions, the auxiliary deck assembly 28 could alternatively shift between such positions without departing from the scope of the present invention. For instance, the auxiliary deck assembly 28 could be laterally slidable between the operating position and a stowed position where the auxiliary deck assembly 28 is at least partly received in a pocket of the pontoon 20. Also, the auxiliary deck assembly 28 could be entirely detached from the primary deck assembly 22 and stowed in another location on the pontoon 20 while remaining detached.

The rod rails 44 are preferably provided as an auxiliary rail to support one or more fishing rods and/or related fishing equipment (not shown). Each rod rail 44 preferably includes a laterally extending rail 84, a pair of stanchions 86, rail brackets 88, fixed pins 90, and removable pins 92.

Preferably, the rail 84 and stanchions 86 each have a tubular metal construction. The illustrated rail 84 is preferably welded to upper ends of the stanchions 86 to provide a unitary rigid rail structure. The rail brackets 88 present a pair of holes 88*a* and are welded to lower ends of the stanchions (see FIG. 6).

However, it will be appreciated that each rod rail 44 could be alternatively constructed without departing from the scope of the present invention. For instance, the rod rail 44 could have an alternative stanchion configuration (e.g., where the rod rail 44 has an alternative number of stanchions 86).

The stanchions 86 are attached to the auxiliary deck assembly 28 by attaching the rail brackets 88 to corresponding platform tabs 52. In particular, fixed pins 90 are extended through corresponding holes 66 in the tabs 52 and holes 88*a* in the rail brackets 88 to pivotally mount the rail brackets 88 to the corresponding platform tabs 52. However, it will be appreciated that an alternative pivotal connection could be used in place of fixed pins 90. For instance, removable pins could be used in place of fixed pins 90 (e.g., so that the rod rails 44 are readily entirely removable from the platform 40).

Thus, the rod rails 44 are pivotally mounted to the platform 40 to swing about a rail hinge axis A2 between a retracted position (see FIGS. 3 and 7) and an extended position (see FIGS. 1 and 6). The illustrated rod rails 44 preferably present a rail length that ranges from about one-quarter (¼) of the length of the platform 40 to about one full length of the platform 40. More preferably, the rod rails 44 each present a rail length of about one-half (½) of the platform length. While the auxiliary deck assembly 28 includes a pair of rod rails 44, the principles of the present invention are applicable where the auxiliary deck assembly 28 includes a single rod rail 44 or more than two rod rails 44.

In the retracted position, the illustrated rod rail 44 is preferably positioned so that the stanchions 86 and rail 84 extend along and, more preferably, contact the auxiliary deck surface 58. In this manner, the rod rails 44 are compactly positioned relative to the platform 40 in the retracted position. Also, as will be discussed below, this compact positioning of the rod rails 44 permits the auxiliary deck assembly 28 to be compactly stowed away.

In the extended position, the rod rails 44 preferably extend transversely to the auxiliary deck surface 58, with the stanchions 86 being substantially perpendicular to the auxiliary deck surface 58. However, the rod rails 44 could be alternatively positioned or oriented relative to the auxiliary deck surface 58 in the extended position without departing from the scope of the present invention.

The illustrated rod rails 44 are preferably manually shifted between the extended and retracted positions. However, it is within the ambit of the present invention where the auxiliary deck assembly 28 includes a powered actuator that is operably connected to the rod rails 44 to drive the rod rails 44 between the extended and retracted positions.

When the auxiliary deck assembly 28 is in the operating position and the rod rails 44 are extended, the rod rails 44 preferably project in an upright direction relative to the auxiliary deck surface 58 to provide a supporting structure. When the auxiliary deck assembly 28 is in the operating position and the rod rails 44 are retracted, the rod rails 44 project laterally along the auxiliary deck surface 58.

In the illustrated embodiment, the rod rails 44 are preferably fully retracted prior to swinging the auxiliary deck assembly 28 from the operating position to the stowed position. Also, as the auxiliary deck assembly 28 is moved to the stowed position, the rod rails 44 generally remain compactly located along the auxiliary deck surface 48 in the retracted position. However, the rod rails 44 might inadvertently swing a small distance away from the auxiliary deck surface 58 as the auxiliary deck assembly 28 is being stowed; however, this should not interfere with swinging of the auxiliary deck assembly 28.

For some aspects of the present invention, the rod rails 44 could be swung toward the retracted position at the same time as the platform 40 being swung to the stowed position. Yet further, the rod rails 44 could be operably powered by a mechanism that swings the rod rails 44 and platform 40 simultaneously. For instance, the auxiliary deck assembly 28 could include a mechanical linkage that is connected to the platform 40 and swings the rod rails 44 in response to corresponding swinging movement of the platform 40.

Preferably, the rod rails 44 can be selectively locked in the extended position by selectively connecting the rod rails 44 and platform tabs 52 to one another with removable pins 92. In particular, the removable pins 92 are extendable through corresponding holes 66 in the tabs 52 and holes 88*a* in the rail brackets 88 when the rod rail 44 is extended. As a result, the installed pins 90,92 cooperatively restrict movement of the rod rail 44 out of the extended position. Retraction of the rod rail 44 can then be permitted by removing the pins 92 to allow relative pivoting between the rail brackets 88 and the tabs 52.

It is also within the ambit of the present invention where the rod rails 44 are configured to be alternatively locked in the extended position. For instance, the rail brackets 88, platform tabs 52, fixed pins 90, and/or the removable pins 92 could be alternatively configured to hold the rod rails 44 in the extended position.

Yet further, the rod rails 44 could be constructed to permit the rod rails 44 to be selectively locked in one or more positions other than the illustrated extended position. However, it may also be possible to eliminate locks entirely. For example, an alternative stop could be provided that permits the rod rail 44 to be swung over center (i.e., slightly past vertical) and thereby releasably retained in the extended position.

Again, the rod rails 44 preferably pivot between retracted and extended positions. However, it is within the ambit of the present invention where the rod rails 44 alternatively shift between such positions. For example, the rod rails 44 could be laterally slidable when moved between the positions. In one such alternative, the rod rails 44 could be slidable into and out of a storage pocket (e.g., where the platform 40 presents the storage pocket). Also, the rod rails 44 could be entirely detachable from the platform 40 for being stowed. For instance, the rod rails 44 could be stowed in another location on the pontoon 20 while remaining detached from the platform 40.

The auxiliary deck assembly 28 preferably includes the illustrated rod rails 44 to support one or more fishing rods and/or related fishing equipment (not shown). For instance, the illustrated rod rails 44 are not sized or otherwise configured for use as a safety rail to ensure that occupants on the platform 40 are prevented from falling off of the platform 40. However, it is within the ambit of the present invention where the rod rails are configured for other uses, such as a safety railing. Also, for some aspects of the present invention, the pontoon 20 could be devoid of any rod rails 44.

Turning to FIGS. 2-5, the powered actuator 46 is operable to power the auxiliary deck assembly 28 between the stowed and operating positions. As mentioned above, the powered actuator 46 also preferably restricts swinging of the platform 40 when the powered actuator 46 is not driving the platform 40.

The powered actuator 46 preferably includes a linear actuator with a motor 94, an actuator body 96, and a slidable piston 98. The linear actuator preferably comprises an electric linear actuator, FA-400-L-12-24, manufactured by Firgelli Automations of Ferndale, Wash. However, the powered actuator 46 could include an alternative mechanism without departing from the scope of the present invention. For instance, the powered actuator 46 could include a pneumatically or hydraulically powered actuator. Also, the actuator 46 could produce a rotational output motion instead of a linear output motion.

The actuator body 96 is preferably attached to and supported on the railing 26 with a mounting plate 100. The mounting plate 100 and actuator body 96 are pivotally attached so that the actuator body 96 can swing relative to the mounting plate 100.

The piston 98 includes an end sleeve 102 with a bore 104 perpendicular to the longitudinal axis of the piston 98. The end sleeve 102 pivotally receives a rod 106 mounted on the platform 40. Thus, the piston 98 is drivingly attached to the platform 40, with the platform 40 being operable to swing relative to the piston 98.

In the usual manner, the piston 98 is slidable into and out of the actuator body 96 between an inner position (see FIG. 5) and outer position (see FIG. 2). In the illustrated embodiment, movement of the piston 98 to the inner position preferably causes the auxiliary deck assembly 28 to move to the stowed position. Also, movement of the piston 98 to the outer position preferably causes the auxiliary deck assembly 28 to move to the operating position. However, it is also within the scope of the present invention where the actuator 46 is alternatively constructed to drive the auxiliary deck assembly 28 between the operating and stowed positions.

In operation, the auxiliary deck assembly 28 can be swung from the stowed position to the operating position by powering the piston 98 from the inner position (see FIGS. 4 and 5) to the outer position (see FIGS. 2 and 3). Once the auxiliary deck assembly 28 is swung to the operating position, the rod rails 44 can then be manually swung from the retracted position (see FIG. 3) to the extended position (see FIGS. 1 and 2). With the rod rails 44 in the extended position, the rod rails 44 are preferably locked in place by interconnecting the platform tabs 52 and rail brackets 88 with removable pins 92.

Similarly, the auxiliary deck assembly 28 can be swung from the operating position to the stowed position. Initially, pins 92 are removed from the platform tabs 52 and rail brackets 88 so that the rod rails 44 can be swung manually to the retracted position. With the rod rails 44 retracted, the piston 98 is retracted from the outer position to the inner position so that the auxiliary deck assembly 28 is swung back to the stowed position.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. An auxiliary deck assembly for a pontoon boat, wherein the pontoon boat includes a primary deck having a primary deck surface that extends between the port and starboard sides, at least one pontoon, and a frame mounting the primary deck to the at least one pontoon, said auxiliary deck assembly comprising:

a stowable auxiliary deck presenting an auxiliary deck surface; and mounting structure configured to mount the auxiliary deck on the frame, said mounting structure swingably supporting the auxiliary deck for swinging movement between stowed and operating positions, said auxiliary deck being configured so that the auxiliary deck surface is substantially level with and extends laterally relative to the primary deck surface when the auxiliary deck is in the operating position, such that the auxiliary deck surface defines an outboard extension of the primary deck surface above the water, said auxiliary deck being further configured so that the auxiliary deck surface is oriented at a generally upright angle relative to the primary deck surface when the auxiliary deck is in the stowed position; and a stop operable to prevent swinging of the auxiliary deck beyond the operating position when the auxiliary deck is swung in the direction from the stowed position to the operating position, with the stop thereby providing support to the auxiliary deck in the operating position, said stop being at least in part defined by the auxiliary deck.

2. The auxiliary deck assembly as claimed in claim 1; and a powered actuator for swinging the auxiliary deck between the stowed and operating positions.

3. The auxiliary deck assembly as claimed in claim 2, said powered actuator comprising an electric linear actuator.

4. The auxiliary deck assembly as claimed in claim 1, said mounting structure partly defining the stop.

5. The auxiliary deck assembly as claimed in claim 4, said mounting structure including at least one bracket configured to be fixed to the frame, said auxiliary deck being pivotally coupled to the at least one bracket.

6. The auxiliary deck assembly as claimed in claim 5, said at least one bracket and the auxiliary deck including complemental faces that interengage when the auxiliary deck is in the operating position, said faces cooperatively defining the stop.

7. The auxiliary deck assembly as claimed in claim 5, said auxiliary deck and said at least one bracket being swingable relative to one another about a hinge axis, said auxiliary deck presenting inboard and outboard margins, with the hinge axis being spaced between the margins.

8. The auxiliary deck assembly as claimed in claim 7, said auxiliary deck presenting a slotted opening that extends in an outboard direction from the inboard margin, said at least one bracket being received in the slotted opening when the auxiliary deck is in the stowed position.

9. The auxiliary deck assembly as claimed in claim 1; and an auxiliary deck rail pivotally mounted on the auxiliary deck for swinging movement between retracted and extended positions, said auxiliary deck rail projecting generally transversely from the auxiliary deck surface when in the extended position, said auxiliary deck rail being positioned generally alongside the auxiliary deck surface when in the retracted position.

10. The auxiliary deck assembly as claimed in claim 9, said auxiliary deck presenting inboard and outboard margins and being swingable about a first hinge axis spaced between the margins, said auxiliary deck rail being swingable relative to the auxiliary deck about a second hinge axis, said second hinge axis being outboard of the first hinge axis.

11. The auxiliary deck assembly as claimed in claim 1, said mounting structure including a mounting bracket configured to be fixed to the frame, with the mounting bracket being pivotally coupled to the auxiliary deck, said auxiliary deck presenting a slotted opening that receives part of the mounting bracket, as the auxiliary deck swings between the stowed and operating positions.

12. The auxiliary deck assembly as claimed in claim 11, said auxiliary deck presenting inboard and outboard margins, said auxiliary deck including a tubular beam that extends between the margins, said beam including a pair of side walls cooperatively forming the slotted opening, said part of the mounting bracket extending outwardly beyond the inboard margin of the auxiliary deck to be received between the side walls of the beam.

* * * * *